United States Patent [19]

Yindra et al.

[11] 4,108,086

[45] Aug. 22, 1978

[54] DRAFTING BOARD AND SUPPORT STRUCTURE THEREFOR

[75] Inventors: Leonard J. Yindra; David F. Evans; Joseph R. Klug, all of Manitowoc, Wis.

[73] Assignee: American Hospital Supply Corporation, Evanston, Ill.

[21] Appl. No.: 624,415

[22] Filed: Oct. 21, 1975

[51] Int. Cl.[2] ..... A47B 3/06

[52] U.S. Cl. ..... 108/157; 108/6; 108/135; 248/225.1

[58] Field of Search ..... 108/1, 2, 3, 4, 5, 6, 108/135, 157; 248/201, 250, 225.1

[56] References Cited

U.S. PATENT DOCUMENTS

| | | | |
|---|---|---|---|
| 285,556 | 9/1883 | Bender | 248/225.1 X |
| 795,957 | 8/1905 | Cartland | 108/157 X |
| 1,529,022 | 3/1925 | Fraser | 108/6 |
| 1,864,039 | 6/1932 | Brownson | 248/225.1 |
| 1,963,721 | 6/1934 | Smith | 108/134 |
| 2,641,427 | 6/1953 | Krogh | 248/225.1 X |
| 2,662,645 | 12/1953 | Piton | 108/135 |
| 3,638,584 | 2/1972 | Cisler et al. | 108/6 |
| 3,640,228 | 2/1972 | Busse | 108/6 |

*Primary Examiner*—Roy D. Frazier
*Assistant Examiner*—Peter A. Aschenbrenner
*Attorney, Agent, or Firm*—Tilton, Fallon, Lungmus & Chestnut

[57] ABSTRACT

A drafting board and its support structure wherein the board may be easily mounted upon and removed from the support structure by only one person, even though the board may be too bulky or heavy to be lifted in its entirety by that person. On-site assembly and disassembly are therefore simplified and expedited.

23 Claims, 9 Drawing Figures

DRAFTING BOARD AND SUPPORT STRUCTURE THEREFOR

BACKGROUND

While the drafting boards of commercial drafting tables vary widely in size, such boards are generally heavy and bulky, often weighing well in excess of 100 pounds and exceeding eight feet in their longer (horizontal) dimension. Most manufacturers pack and ship such boards separately, leaving the job of assembling the boards to their supporting bases to be undertaken when the components reach their destination. Because of the size and weight of the boards, a typical installation requires the combined efforts of two or more workers, usually positioned at opposite ends of the board, to lift the board into position and to insert and tighten the necessary screws or other connectors.

In an effort to simplify the on-site mounting operation, some manufacturers fix the mounting brackets to the boards at the factory with the thought that it is easier to secure the brackets of a board to a support base than to secure a board to brackets pre-mounted upon such a base. While such a construction does have the advantage of simplifying on-site assembly, it still ordinarily requires the efforts of at least two workers. The pre-mounting of the brackets upon the boards has a further disadvantage of hindering factory inspection of the fit and operation of the tilt mechanism with the base unit combination prior to shipment. Thus, the pre-mounting of the brackets upon a board not only fails to eliminate the need for an assembly team for on-site assembly, but also does not easily permit factory inspection of a tilt mechanism and base combination that comprises the total product.

U.S. Pat. Nos. 3,140,559, 3,273,517, 3,638,584, and 3,698,327 are illustrative of conventional drafting table and board constructions.

SUMMARY

This invention is concerned with an improved drafting board and support structure which permits a single operator to mount or detach drafting boards of sizes and weights that would previously have required a team of two or more operators. Not only does the improved construction facilitate on-site assembly of a drafting table by making it possible for such work to be done by only one operator, but the time required for such assembly is reduced because simpler and more readily applied fasteners are used, and there is no need for precise positioning during assembly. In addition, proper fit and operation of major components are assured by factory assembly and installation.

An important aspect of this invention lies in the recognition that if the means for connecting a drafting board to a base are located near opposite ends of the board, and if each connection involves a relatively large target area which permits lateral sliding movement of the board after it is generally in place and during final adjustment, then even if the board is of a size or weight which would normally require two-man installation, a single operator may easily mount the board if he is capable of lifting one of its ends. In such a mounting procedure, the operator simply lifts one end of the board and positions it so that the rearwardly-projecting connector at that end is supported by a generally horizontal bearing surface of the base. In the event that the parts are reversed with the bearing surface being provided by the board and the connector existing as part of the bracket means of the base, the operation is essentially the same; that is, one end of the board is lifted until the connector and the bearing surface engage each other and support that end of the board. Then, using the initial attachment as a pivot point, the operator lifts the opposite end of the board and brings the bearing surface and connector at that end into operative engagement. After whatever lateral repositioning may be required, the board is anchored in place by locking means which secure the board and bracket means against independent relative movement.

In the best mode presently known for practicing the invention, at least one end of the bearing surfaces is interrupted by a slot which is adapted to receive one of the connectors, thereby limiting the extent of further lateral movement of the board during a mounting procedure. Where the bearing surfaces are provided by the base, the slot (or slots) is open-topped, extending downwardly from the generally horizontal bearing surface at a point intermediate the ends thereof. Conversely, if the bearing surfaces are provided by the board as, for example, the lower surface portions of one or more horizontal hanger members secured to the board, then the slot is open at its bottom. The connectors may take the form of screws or cleats provided either by the board or by the bracket means. In one embodiment, the connectors comprise the upper portions of the brackets themselves.

In one form of the invention, a pair of slots are provided and are of T-shaped configuration to permit limited lateral sliding movement of the board during mounting and final adjustment. When both of the screws or other connectors are in place within the slots, they are tightened to anchor the board in position. Since the entrance to each T-shaped slot is bordered on opposite sides by bearing surface portions, an operator lifting a large board into position need not even see the bracket which is the target for attachment. All that is required is that the connector and bearing surface of the bracket and board be brought together so that the lifted end of the board is supported by that bracket. Thus, if the bearing surfaces and slots are provided by the bracket means, and the connectors take the form of screws attached to the board, the operator simply lifts one end of the board until the shank of the screw rests upon the bearing surface of the bracket. With slight lateral movement one way or the other, the board may then be repositioned so that the screw drops into the open-topped slot. Once the screw has entered the slot, the end portion of the board associated therewith is fully supported by the bracket and cannot become disengaged therefrom in the absence of a lifting force supplied to the associated end portion of the board. Specifically, the slotted front panel of the bracket is interposed between the rear surface of the board and the head of the screw, with the shank of the screw extending through the enlarged lower end of the slot. Even a lifting force applied to the end of the board would be ineffective in detaching the board from the bracket unless care were taken to shift the board laterally to position the shank of the screw directly below the entrance to the slot.

The horizontally-enlarged base portion of each T-shaped slot performs an important function in permitting limited lateral displacement of the board after one connector (screw) is in place and the second connector is being inserted. Even if the connectors have their centers spaced apart a distance precisely equal to that of the slot entrances, a binding action might occur because the board is not installed by lowering both connectors simultaneously into the slots but rather by first positioning one connector in its slot and then pivoting the board to introduce the second connector into its slot. Since the distance between the entrances of the two slots is not precisely the same as the distance between the entrance of one slot and the base portion (in direct alignment with the entrance) of the other slot, the enlarged base portion of the slot in which one of the connectors is already received allows the slight lateral displacement of the board which may be necessary as the second screw connector enters its slot. Furthermore, the enlarged horizontal or base portions of the respective slots permits either intentional or unintentional manufacturing variance between connector and slot distances without impairing assembly operation.

Other advantages and objects of the invention will become apparent from the specification and drawings.

DRAWINGS

DESCRIPTION

Figure 1:
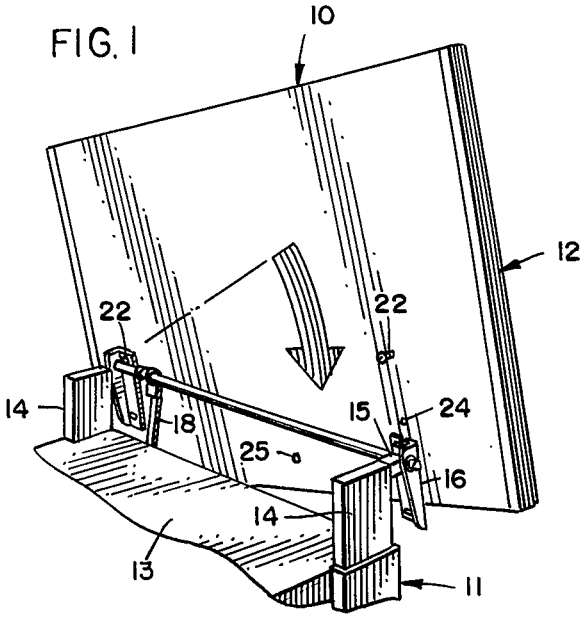
FIG. 1 is a fragmentary perspective view illustrating a drafting board and its supporting structure in an early stage of an assembly operation.
Figure 2:
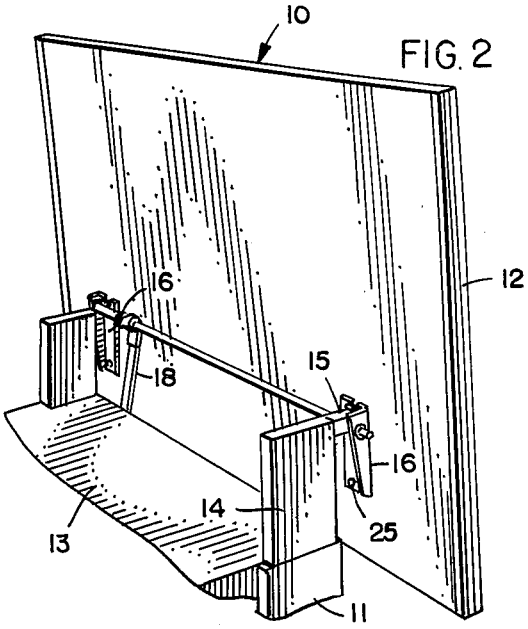
FIG. 2 is a perspective view similar to FIG. 1 but showing the parts in a subsequent stage in the assembly operation.
Figure 4:
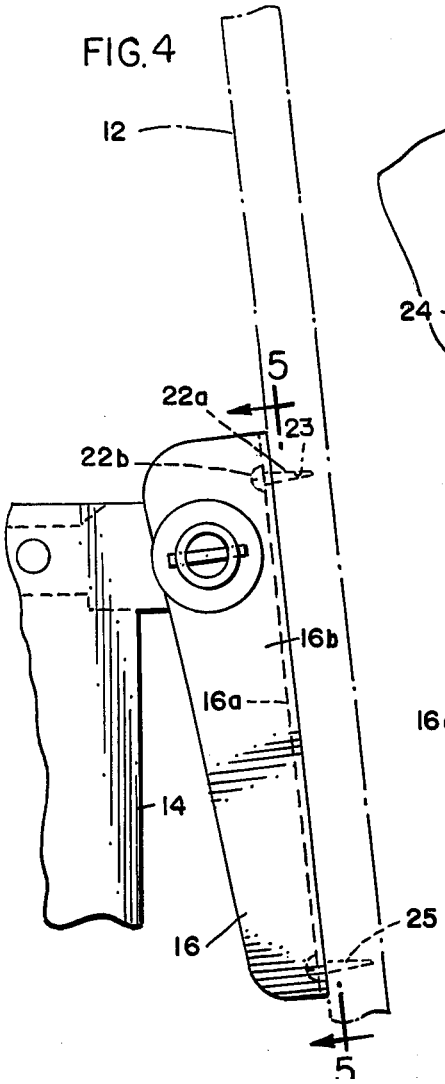
FIG. 4 is an enlarged fragmentary side elevational view of the support with emphasis on details of the bracket structure and its relationship to a drawing board.

Referring to the embodiment illustrated in FIGS. 1–5, the numeral 10 generally designates a table having a support base and a top 12. The top takes the form of a drafting board which may, for example, be constructed in accordance with the teachings of U.S. Pat. No. 3,234,650. Such boards are generally intended for industrial use, commonly exceed six feet in length and, in the larger sizes, may weigh 100 pounds or more. While this invention is directed particularly to the problems of on-site installation of such large and cumbersome boards, it is believed evident that the invention may also find use in the mounting of other boards or table tops which are to be detachably connected to the bracket-equipped tilt mechanisms of support bases.

Base 11 may be any of a variety of well-known structures in common use for supporting drafting boards at different selected elevations and angular positions. Reference is made, for example, to U.S. Pat. Nos. 3,140,559 and 3,273,517. The main body 13 of the base 11 may comprise a cabinet or desk. A pair of telescoping standards 14 are disposed at opposite ends of the body and are adapted to rest securely upon a floor surface. Supporting means 15 project forwardly from the upper ends of the standards 14 and pivotally support a pair of brackets 16. The angular position of the brackets is controlled by a lever 17 and its locking mechanism 18, such mechanism being essentially the same as disclosed in U.S. Pat. Nos. 3,140,559 and 3,273,517, although other locking and release systems may be utilized. A counterbalancing mechanism, taking the form of a torsion bar as set forth in U.S. Pat. No. 3,273,517, may be provided, although it should again be understood that any suitable or conventional counterbalancing mechanism may or may not be used.

Each bracket is provided with a front panel **16*a* and at least one side member 16*b*. The front panel terminates in an upper edge surface 16*c* which, in the embodiment illustrated, extends in a generally horizontal direction. A slot 20 extends downwardly from each upper edge surface 16*c*. It is to be observed that the entrance 20*a* to each slot is relatively narrow and is disposed intermediate the sides of the bracket so that substantially portions of 16*c*, constituting generally horizontal bearing surfaces, are disposed on opposite sides of that entrance. Below the entrance, the slot expands outwardly on each side to define a laterally enlarged main portion 20*b***.

Near its lower end, each bracket is provided with an opening 21. In the embodiment illustrated, openings 21 are horizontally elongated; however, it is to be understood that such elongation is primarily for assembly convenience and manufacturing tolerance and that, if desired, openings 21 may be circular or of some other suitable configuration.

A pair of primary connectors 22 are mounted upon the backside of board 12 adjacent opposite ends thereof. In the form of the invention depicted in FIGS. 1–5, each of the horizontally-spaced connectors takes the form of a screw having a threaded shank **22*a* and an enlarged head 22*b*. The parts are dimensioned so that the entrance portion 20*a* of each slot is wider than the diameter of shank portion 22*a* but smaller than the size of head 22*b*. Similarly, the height of the main portion 20*b* of each slot is less than the diameter of head 22*b* but greater than that of shank 22*a***.

It is to be understood that each screw connector 22 may be equipped with a washer and that such a washer may if desired be formed integrally with the screw. Whether or not such a washer is formed integrally with or attached to the screw, it would in any event serve functionally as an enlargement of head **22*b*** and, to that extent, is to be regarded as a part of the head structure.

The screws 22 are threadedly received in openings 23 in the board or top 12. Prior to installation, such screws are adjusted so that the distance between the opposing surfaces of head portions **22*b* and the rear surface of the board is substantially greater than the thickness of front panels 16*a*** of the brackets.

Directly below screws **22*b* and openings 23 are openings 24 for threadedly receiving threaded connectors or screws 25. The distance between openings 23 and 24 corresponds with the distance between slots 20 and 21. As described below, screws 25** are not connected to the board until a final step in the installation procedure.

Figure 3:
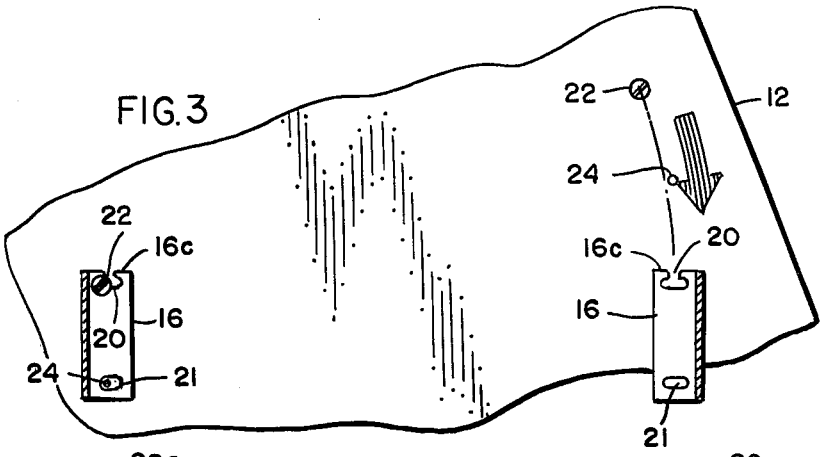
FIG. 3 is a somewhat schematic rear sectional view illustrating a pair of brackets with a board in the process of being installed, the parts being in essentially the same relative positions as illustrated in FIG. 1.
Figure 5:
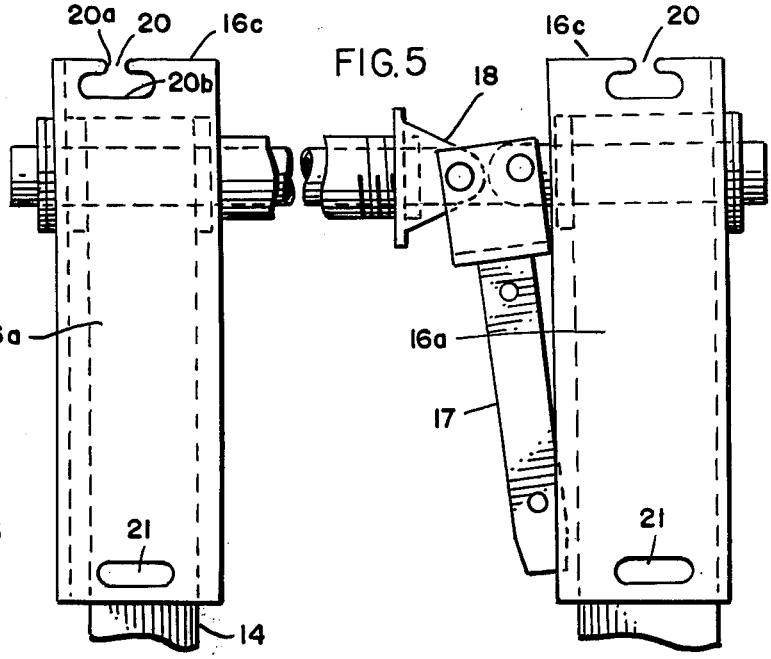
FIG. 5 is a front elevational view of the bracket assembly taken along line 5—5 of FIG. 4.
Figure 6:
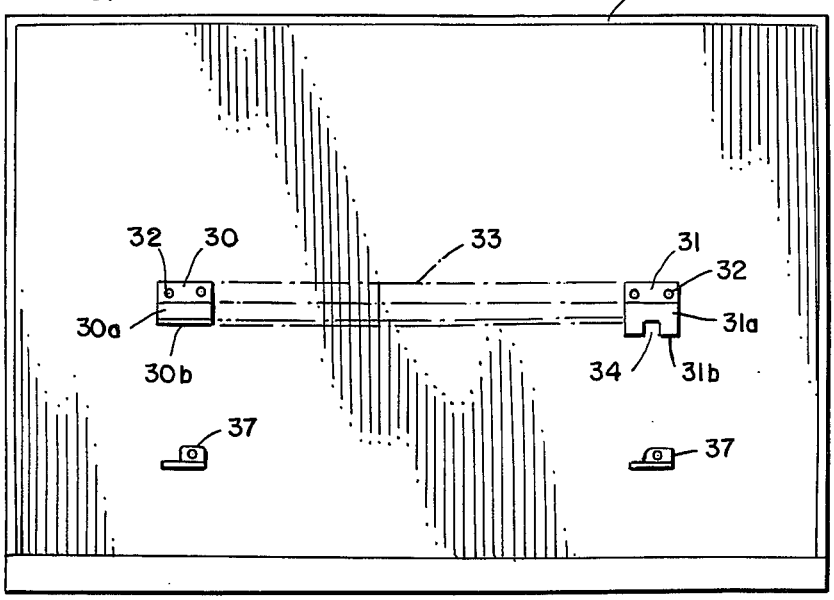
FIG. 6 is a rear elevational view of a drawing board or top constituting a second form of the invention.
Figure 7:
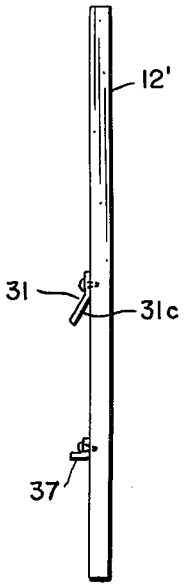
FIG. 7 is an end elevational view of the board illustrated in FIG. 6.
Figure 8:
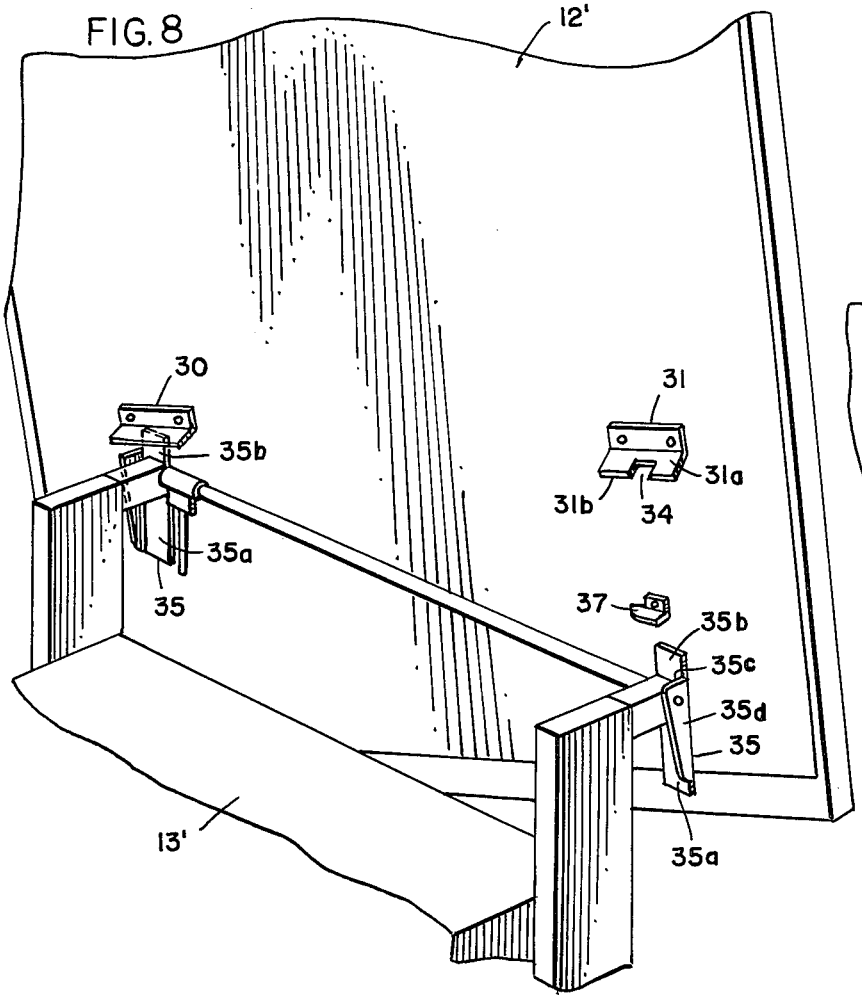
FIG. 8 is a fragmentary perspective view illustrating the board of FIG. 6 as it is being mounted upon a base.

The assembly of a board 12 and its support structure 11 may be easily accomplished by simply lifing one end of the board into position so that the shank of one of the connectors enters an appropriate slot 20 in one of the brackets 16. Thereafter, using that connector as a pivot, the opposite end of the board is lifted and then lowered as shown in FIG. 1 so that the shank of the other connector 22 enters the slot of the other bracket 16. During such an operation, each connector before it enters its intended slot may slide horizontally along the upper edge 16*c* of the bracket. Furthermore, once the connector has entered the main portion of the slot, limited lateral movement, to the extent permitted by the horizontal dimension of slot portion 20*b*, may take place. Thus, as shown in FIG. 3, the connector 22 on the left has slid to the extreme left end of slot 20. As the opposite end of the board is lowered, slight displacement of the entire board to the right may be necessary in order to bring the shank of the right connector 22 into alignment with the entrance of the slot for the right hand bracket 16. Finally, when both connectors 22 have entered the slots 20, the lower connectors or screws 25 are inserted into openings 24 through slots 21 in the brackets, and all of the connectors are then tightened. The assembly is thereby completed and, since such assembly can be accomplished by lifting only one end of the board at any given time, such assembly may be readily accomplished on site by only one operator or worker. It is to be observed that screws 25, which serve as locking means for securing the board and bracket assembly against independent relative movement, are applied only after the board is suspended upon the brackets in its final position of adjustment; hence, the operator is not required to hold the board in position while applying the anchoring means.

A primary purpose of on-site assembly is to facilitate packing and shipping of such a table. The ease of assembly and disassembly (which is the reverse of the assembly steps) also becomes important when repair or replacement of a board is required.

The embodiment illustrated in FIGS. 6–9 shows that an operative assembly may be provided by reversing the parts so that the bearing surface portions are provided by the board and the connectors which engage those surfaces are provided by the brackets. Board 12' is provided along its backside with hangers 30 and 31. The two hangers are secured by screws, rivets, or any other suitable fastening means to the backside of the board adjacent opposite ends thereof. As a practical matter, it is preferable to provide two hangers as shown; however, as indicated by broken lines 33, a single elongated hanger bar, of which hangers 30 and 31 constitute end portions, may be provided.

Each hanger has a downwardly and rearwardly projecting flange portion 30*a* and 31*a*, respectively. The lower edge surfaces 30*b* and 31*b*, and particularly the undersurfaces (i.e., 31*c*), constitute horizontally elongated bearing surfaces to support the top for limited lateral sliding movement during assembly of the board 12' to base 13'. At least one of the flanges 30*a* and 31*a* is provided with a downwardly opening notch or slot 34. If desired, both flanges may be slotted. In the illustration given, only the right-hand bracket is slotted and its flange 31*a* is longer than unslotted flange 30*a* to an extent approximating the height of the slot.

Base 13' is essentially the same as base 13 already described except that brackets 35 have unslotted front panels 35*a* and each front panel has an upward extension or cleat portion 35*b*. Each cleat serves as a connector for slidably engaging a bearing surface of one of the hangers 30 and 31.

Thus, during an installation operation, an operator first lifts one end of the board so that the bearing surface of one of the hangers (for example, hanger 30) engages the upstanding cleat or connector 35*b* to support that end of the board upon its bracket.

Figure 9:
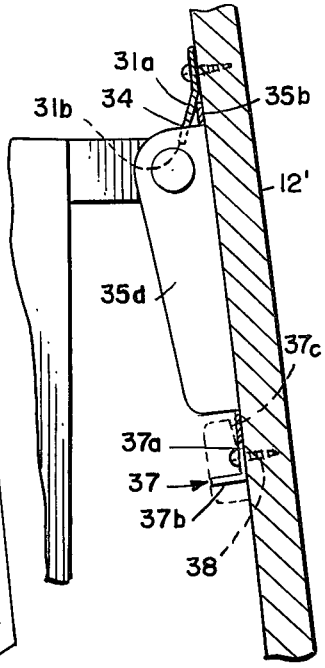
FIG. 9 is an enlarged vertical sectional view illustrating the cooperative relationship between the parts of the assembly.

Thereafter, the opposite end of the board is raised and then lowered so that the bearing surface or surfaces of hanger 31 engage the other bracket. Because of the greater downward extension of flange 31*a*, bottom edge 31*b* tends to engage the top edge 35*c* of side panel 35*d*, such top edge also constituting part of the connector. The board may then be slid laterally until edge portion 35*c* enters slot 34, at which time the board is restrained against any substantial lateral sliding movement. FIG. 9 illustrates the relationship of parts when the upper portion of the bracket's side panel is received within slot 34.

Any suitable anchoring means for locking the board and bracket means against independent relative movement may be used. For example, the lower portions of front panels 35*a* may be apertured to receive screws 25 as described in connection with the embodiment of FIGS. 1–5. However, in the form depicted in FIGS. 6–9, the front panels are imperforate and the anchoring elements take the form of cam members 37 pivotally connected by screws 38 to the lower rear portions of board 12'. Each cam element is provided with an apertured portion 37*a* through which screw 38 extends and a rearwardly projecting wing portion 37*b*, the wing portion having a sloping forwardly-facing edge 37*c*. When the cam element is turned into the position shown in dotted lines in FIG. 9, the sloping edge 37*c* engages the panel 35*a* of the bracket to anchor the board and bracket assembly against relative movement.

While in the foregoing embodiments of the invention have been disclosed in considerable detail for purposes of illustration, it will be understood by those skilled in the art that many of these details may be varied without departing from the spirit and scope of the invention.

We claim:

1. A tiltable table top and base assembly comprising a base adapted to rest upon a floor surface and having bracket means mounted for pivotal movement about a horizontal pivot axis, a table top detachably secured to said bracket means for pivotal movement therewith from a substantially vertically disposed position to a substantially horizontally disposed position, one of said table top and bracket means, when in the vertically disposed position, having a pair of generally horizontal bearing surface portions and the other of said table top and bracket means having a pair of laterally-spaced connectors independently and slidably engagable with said surface portions, said bearing surface portions being laterally spaced and horizontally aligned relative to each other, said bearing surface portions and said connectors engaging each other at locations intermediate the upper and lower limits of said table top and along the backside thereof when said table top is in its vertically disposed position, whereby, in assembling said table top and said base, one end of said table top when in the substantially vertically disposed position may be lifted and supported by first positioning one of said connectors in sliding engagement with one of said bearing surface portions, and thereafter, the opposite end of said table top may be lifted and supported by positioning the other of said connectors in engagement with another of said bearing surface portions, and means anchoring said table top to said bracket means against independent relative movement.

2. The assembly of claim 1 in which said bearing surface portions are provided by said bracket means.

3. The assembly of claim 2 in which said bearing surface portions comprise narrow and laterally-elongated upper surfaces of said brackets.

4. The assembly of claim 3 in which at least one of said bearing surface portions is provided intermediate the ends thereof with an open-topped slot for receiving one of said connectors.

5. The assembly of claim 4 in which said slot is of inverted T-shaped configuration with a generally vertical entrance portion and a horizontally-elongated main portion.

6. The assembly of claim 4 in which each of said bearing surface portions is provided with an open-topped slot.

7. The assembly of claim 4 in which said connectors comprise screws attached to said table top.

8. The assembly of claim 1 in which said pair of laterally-spaced horizontal bearing surface portions face generally downwardly and are provided by at least one horizontally-elongated hanger along the backside of said table top, said connectors comprising upper portions of said brackets which are slidably engagable with said bearing surface portions.

9. The assembly of claim 8 in which a pair of laterally-spaced hangers are provided along the backside of said table top.

10. The assembly of claim 9 in which upper portions of said brackets are received between portions of said hangers and said table top.

11. The assembly of claim 8 in which at least one of said horizontal bearing surface portions is interrupted by an open-bottomed slot adapted to receive an upper portion of one of said brackets to limit lateral sliding movement of the parts.

12. The assembly of claim 1 in which said anchoring means comprises at least one screw connecting said bracket means and said table top against relative movement.

13. The assembly of claim 1 in which said anchoring means comprises at least one cam locking element rotatably mounted upon said table top and engagable with said bracket means for locking said bracket means and table top against relative movement.

14. A tiltable table top and base assembly comprising a base having a pair of horizontally-spaced brackets with front panels disposed in coplanar relation and normally extending along a generally vertical plane when said table top and said brackets are in a generally vertically disposed position, said brackets being mounted for pivotal movement about a horizontal pivot line parallel with said panels, and a table top detachably mounted upon said brackets and having a rear surface disposed against said front panels when in the generally vertically disposed position, each of said front panels of said brackets having an upper edge and having an open-topped slot extending downwardly therefrom, and a pair of connectors secured to the rear of said table top and having shank portions projecting rearwardly through said slots, said connectors each having enlarged head portions disposed behind said front panels to prevent forward axial movement of said connectors through said slots.

15. The assembly of claim 14 in which said connectors comprise screws threadedly secured to said table top.

16. The assembly of claim 15 in which each of said slots is of inverted T-shaped configuration with a generally vertical entrance portion and a horizontally elongated main portion.

17. The assembly of claim 16 in which the width of said entrance portion and the height of said main portion are greater than the thickness of the shank portion of said connector but less than the width of said head portion.

18. The assembly of claim 17 in which said shank portion of said connectors are spaced apart a distance approximating the distance between the entrance portions of said slots.

19. The assembly of claim 14 in which said connectors comprise screws threadedly secured to said table top, said head portions tightly and frictionally engaging said brackets to hold said table top in place.

20. A base for detachably and tiltably supporting a drafting board, said board having a pair of horizontally-spaced connectors with enlarged head portions projecting rearwardly from the back of said board, said base comprising a pair of horizontally-spaced standards, a pair of brackets pivotally mounted upon said standards for movement about a horizontal pivot line between a normal generally vertical position and a generally horizontal position, each of said brackets including a front panel having an upper edge and having an open-topped slot extending downwardly therefrom when said brackets are oriented in their generally vertical positions, said front panels of said brackets being coplanar, said slots being adapted to sequentially receive said pair of connectors projecting rearwardly from a drafting board when, during a board-mounting operation, said board is generally vertically oriented and is tipped first to introduce one connector and then the other connector into the respective slots of the generally vertically oriented brackets.

21. The structure of claim 20 in which each of said slots is of inverted T-shaped configuration having a generally vertical entrance portion extending downwardly from the upper edge of said bracket and a main portion communicating with said entrance portion and extending generally horizontally.

22. The structure of claim 21 in which said upper edge of each bracket projects laterally from opposite sides of the entrance portion of said slot.

23. The structure of claim 20 in which said connector are screw connector and said board is horizontally elongated with opposite end portions provided with said rearwardly-projecting screw connectors threadedly retained by said board, each screw connector having a threaded shank and an enlarged head portion, the entrance and main portions of said slot having a width and height, respectively, that are greater than the diameter of said shank and less than the diameter of said head portion, whereby, each screw connector is capable of limited vertical and horizontal sliding movement in the slot associated therewith.

* * * * *